US007792316B2

(12) United States Patent
Tan et al.

(10) Patent No.: US 7,792,316 B2
(45) Date of Patent: Sep. 7, 2010

(54) PORTABLE STORAGE CONTAINER WITH CABLE MANAGEMENT FUNCTIONALITY AND A METHOD FOR MANAGING CABLES OF A PORTABLE STORAGE CONTAINER

(75) Inventors: Jason Tan, Singapore (SG); Kar Choon Ng, Singapore (SG)

(73) Assignee: Creative Technology Ltd, Singapore (SG)

( * ) Notice: Subject to any disclaimer, the term of this patent is extended or adjusted under 35 U.S.C. 154(b) by 1260 days.

(21) Appl. No.: 11/340,959

(22) Filed: Jan. 27, 2006

(65) Prior Publication Data

US 2007/0189565 A1 Aug. 16, 2007

(51) Int. Cl.

| | |
|---|---|
| ***H04R 1/02*** | (2006.01) |
| *H04R 25/00* | (2006.01) |
| *H04R 9/06* | (2006.01) |
| *H01R 13/62* | (2006.01) |
| *B65D 85/02* | (2006.01) |
| *B65D 85/00* | (2006.01) |

(52) U.S. Cl. ..... 381/386; 381/388; 381/301; 381/333; 439/367; 206/303; 206/320; 206/702

(58) Field of Classification Search ..... 381/87, 381/301, 304, 305, 333, 386

See application file for complete search history.

(56) References Cited

U.S. PATENT DOCUMENTS

| | | | | |
|---|---|---|---|---|
| 4,650,073 | A | 3/1987 | Young | |
| 5,004,105 | A * | 4/1991 | Freadman | 206/576 |
| 5,979,591 | A | 11/1999 | Harrison | |
| 6,966,791 | B1 * | 11/2005 | Farr | 439/367 |
| D535,976 | S | 1/2007 | Ng | |
| 2003/0012397 | A1 * | 1/2003 | Gurner | 381/386 |

FOREIGN PATENT DOCUMENTS

| | | |
|---|---|---|
| EP | 1489820 | 12/2004 |
| FR | 2243574 | 4/1975 |
| FR | 2243574 A2 * | 4/1975 |
| JP | 2004-056636 | 2/2004 |

* cited by examiner

*Primary Examiner*—Brian Ensey
*Assistant Examiner*—Sunita Joshi

(57) ABSTRACT

There is provided a portable storage container with cable management functionality, including: a case constructed from a rigid material with a first extent and a second extent in an adjacent relationship therewith, the first and second extent each defining an interior space for the placement of at least one speaker driver in at least one extent, the at least one speaker driver being connected through a cable with a connector, rear portions of the first and second extent being pivotally coupled together, at least one extent having an extended rim along an edge of the interior space, the rim defining a groove along the edge of the interior space, the groove being used for aligning the cable, and a fastener for fastening edges of the first and second extent. The fastener may feed the cable into the groove when fastening the edges of the first and second extent. A corresponding method for managing at least one cable in a portable storage container is also disclosed.

21 Claims, 2 Drawing Sheets

PORTABLE STORAGE CONTAINER WITH CABLE MANAGEMENT FUNCTIONALITY AND A METHOD FOR MANAGING CABLES OF A PORTABLE STORAGE CONTAINER

FIELD OF INVENTION

This invention relates to a portable storage container with cable management functionality and a method for managing at least one cable of a portable storage container. It specifically, though not exclusively, relates to a set of speakers encased in a portable casing with cable management functionality.

BACKGROUND

Portable speakers used together with portable music players are common devices and are seen in many places, such as, for example, in homes, in offices, at places of recreation and so forth. However, transporting these speakers is a problem as the speaker wires need to be managed properly to prevent unnecessary entanglements and other consequential inconveniences. There are speakers with retractable wiring, but the durability of the cable retracting mechanisms employed in those speakers is questionable.

For many portable speakers, indiscriminate handling of the speakers during transportation causes damage to the speaker drivers. This is especially so for speakers which are of reduced dimensions and employ more intricate speaker drivers. The damage is caused by impact which affects the mechanical nature of the speaker drivers.

SUMMARY

In a first aspect of the present invention, there is provided a portable storage container with cable management functionality. The container includes: a case constructed from a substantially rigid material with a first extent and a second extent in an adjacent relationship therewith, the first and second extent each defining an interior space for the placement of at least one speaker driver in at least one extent, the at least one speaker driver being connectable through a cable with a connector, rear portions of the first and second extent being pivotally coupled together, at least one extent having an extended rim along an edge of the interior space, the rim defining a groove along the edge of the interior space, the groove being used for receiving or aligning the cable, and a fastener for fastening edges of the first and second extent. Preferably, the fastener includes a guide to feed the cable into the groove when fastening the edges of the first and second extent. The adjacent relationship between both extents may be side-by-side, substantially perpendicular, or any position in-between the aforementioned. The fastener may be either a toothed or toothless zipper.

It is preferable that the rigid material is made from wood, metal or plastic. It is advantageous that the rigid material of the case protects the contents enclosed in the container. The connector may preferably be a USB male connector, an IEEE 1394 male connector, a customized male connector, or an audio jack. The at least one speaker driver may be connected through the connector to receive input like audio signals and power. The container may also be used for the placement of a media player, a portable radio tuner or a mobile phone.

Preferably, the interior space in each extent may further including a holder for the at least one speaker driver and the holder may advantageously be able to absorb impact to prevent damage to the at least one speaker driver, and the holder may allow for the movement of the at least one speaker driver. It is also advantageous that a peripheral wall of each extent, and the pivotal coupling of the first and second extents, is used for supporting the container in an upright position. The pivotal coupling of the first and second extents may advantageously include a receptor for the connector when the container is fastened.

Advantageously, the exterior surfaces of the first and second extent may allow for adherence of interchangeable skins for a varied appearance. The container may preferably be fastened during transportation and unfastened during use.

In a second aspect of the present invention, there is provided a method for managing a cable in a portable storage container using a fastener with a guide to feed the cable into a groove, wherein the groove is along an edge of the container. The portable storage container may include at least one speaker driver and may also include a media player, a portable radio tuner or a mobile phone.

DESCRIPTION OF DRAWINGS

In order that the present invention may be fully understood and readily put into practical effect, there shall now be described by way of non-limitative example only preferred embodiments of the present invention, the description being with reference to the accompanying illustrative drawings.

For the drawings.

DESCRIPTION OF PREFERRED EMBODIMENTS

Figure 1:
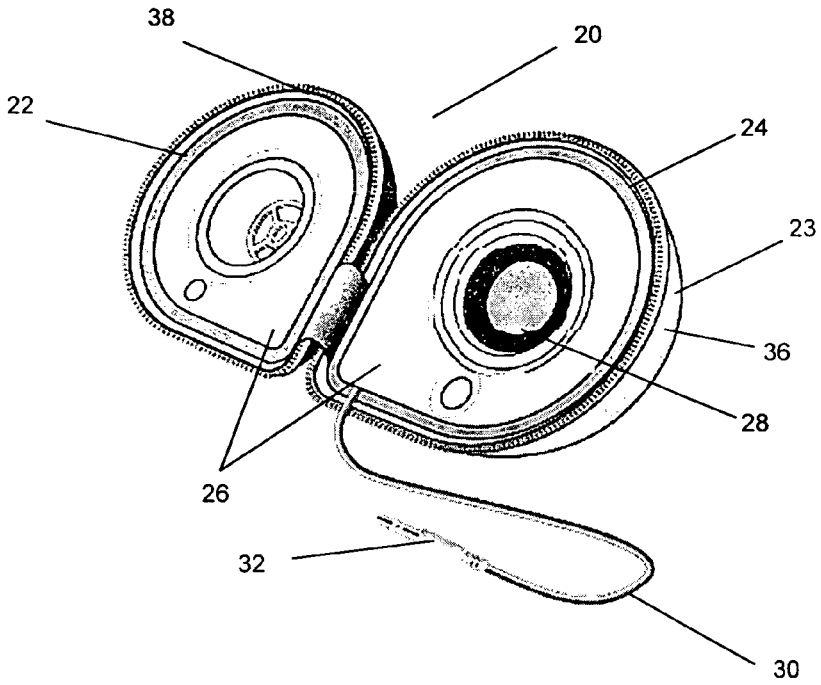
FIG. 1 is a perspective view of a preferred embodiment when unfastened and standing upright.
Figure 2:
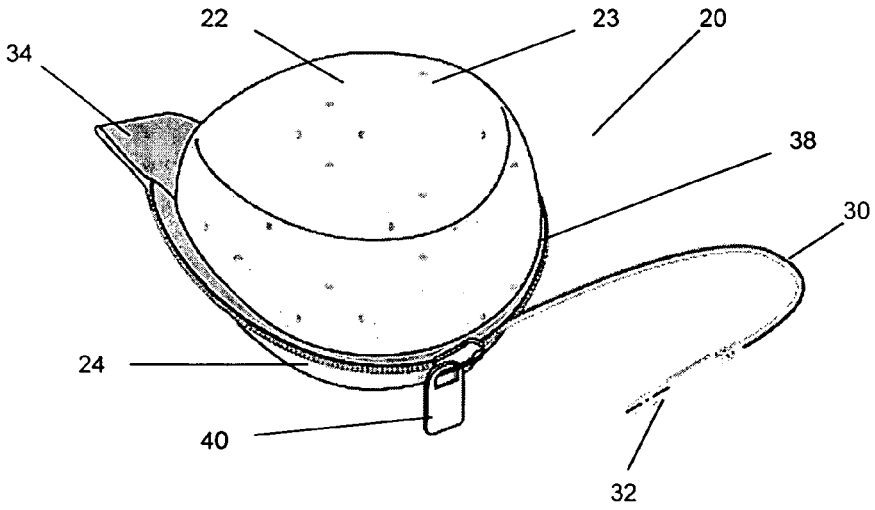
FIG. 2 is a perspective view of a preferred embodiment during fastening.
Figure 3:
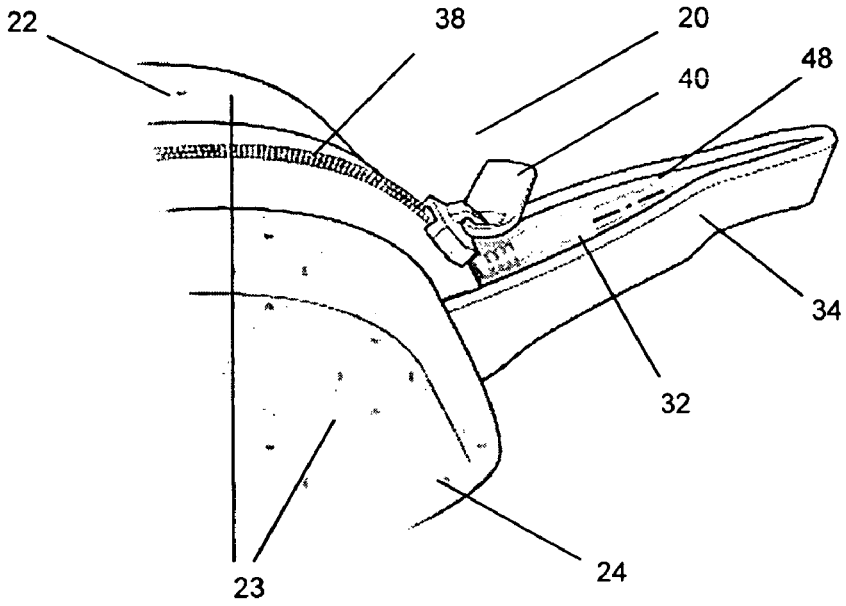
FIG. 3 is a perspective view of a rear portion of a preferred embodiment after complete fastening.

Referring to FIGS. 1 to 3, there is provided a portable storage container 20 with cable management functionality. The container 20 includes a case preferably constructed from a relatively rigid material such as, for example, wood, metal or plastic. The relatively rigid material of the case may protect the contents enclosed in the container 20.

The case in the container 20 has a first extent 22 and a second extent 24 in an adjacent relationship. When the portable storage container 20 is in use in an unfastened configuration, the adjacent relationship may be side-by-side (as shown in FIGS. 1 and 5), substantially perpendicular to one another, or any position between side-by-side and perpendicular. The first 22 and second 24 extents may each define an interior space for the placement therein of at least one speaker driver. The at least one speaker driver may be connected to a source through a cable 30, with a connector 32, to receive audio signals and/or power. The connector may be a USB male connector, IEEE 1394 male connector, a customized male connector, or an audio jack. It should be noted that the at least one speaker driver may have a power source such as, for example, solar cell(s), batteries and capacitors.

FIG. 1 shows the first 22 and second 24 extent each having a holder 26 for the at least one speaker driver. If the interior space is sufficiently large, a tweeter may also be located in an extent of the case of the container 20 by using a holder 26 that can accommodate the tweeter(s). The first extent 22 as shown does not have a speaker driver while the second extent 24 includes a single speaker driver 28. Besides holding the at least one speaker driver 28 in a predetermined position, the holder 26 may also able to absorb impact forces to prevent, reduced or minimize damage to the at least one speaker driver 28 by isolating the driver 28 such that any force exerted directly on the second extent 24 is significantly dissipated before reaching the driver 28. The holder 26 may alternatively be a foam molding that may be able to hold the at least one speaker driver 28 in a predetermined position and also significantly absorb impact force. The holder 26 may allow for movement of the speaker driver 28. Exterior surfaces of the first 22 and second 24 extents may allow for the adherence of interchangeable skins 23 for a varied external appearance. FIGS. 1 to 3 show a skin 23 with camouflage markings, but the markings may be of any design. The skins may be applied adhesively on the exterior surfaces of the first 22 and second 24 extents or may be elastically sheathed onto the exterior surfaces of the first 22 and second 24 extents.

Rear portions of the first 22 and second 24 extents may be pivotally coupled 34 together as shown in FIGS. 1 to 3. The pivotal coupling 34 of the first 22 and second 24 extents may be flexible, or may be substantially rigid and act as a structural piece for supporting the container 20 in an upright position. FIG. 1 shows the unfastened container 20 resting on a surface.

The coupling 34 may be used as a stand when the container 20 is positioned in the upright position as shown in FIG. 1. A peripheral wall 36 of each extent 22, 24 may be for supporting the container 20 together with the coupling 34 in the upright position. This is irregardless of whether the extents 22, 24 are arranged side-by-side (as shown in FIGS. 1), substantially perpendicular to one another or any position between them.

In this instance where only the second extent 24 includes a speaker driver 28, the first extent 22 may be for the placement of a device such as, for example, a media player, a portable radio tuner, or a cellular or mobile phone. This is possible if the devices are able to fit within the space confines of the first extent 22. The shape of the first extent 22 may be predetermined to fit a particular shape of the device to be placed in the first extent 22. A holder to enable the mounting of the devices may or may not be used in the first extent 22. This flexibility of using the first extent 22 to contain the device allows for the speaker driver 28 in the second extent 24 to be conveniently connectable to the device located in the first extent 22, and for both the device and the speaker driver 28 to be protected within the container 20. It should be noted that the first extent 22 may also be used to house at least one speaker driver.

Figure 4:
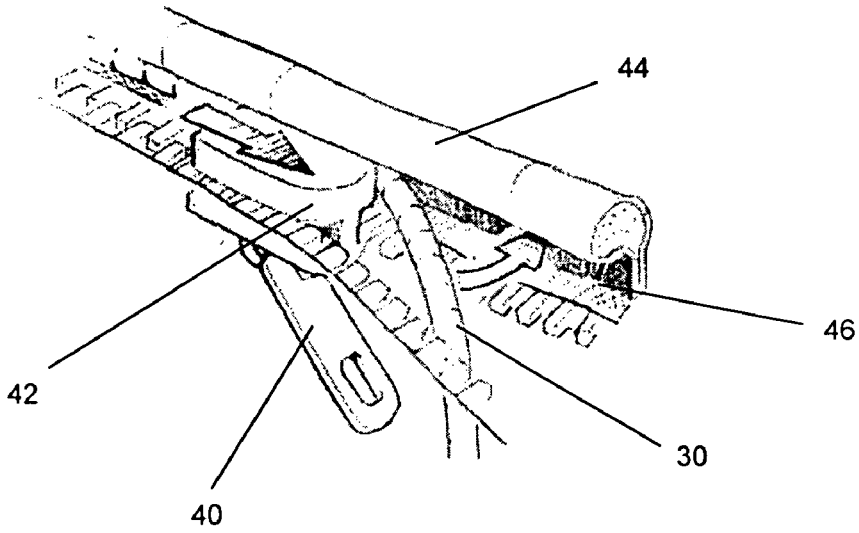
FIG. 4 is a perspective view of the fastener managing a cable in a preferred embodiment.

The container 20 may have a cable management functionality which is shown in greater detail in FIGS. 2 to 4. FIG. 2 shows how the cable 30 is progressively coiled around a peripheral edge 38 of the container 20 as a fastener 40 fastens both extents 22, 24 together. The fastener 40 may be a toothed zipper (as shown), a toothless zipper, or any other "sliding" type of fastener. A toothed zipper may be preferable to a toothless zipper as a seam fastened with a toothed zipper generally requires a greater force to be separated. Referring to FIG. 4, the fastener 40 includes a guide 42 for the cable 30. In a preferred embodiment of the present invention, the second extent 24 may have an extended rim 44 along an edge of the interior space of the second extent 24. The rim 44 may define a groove 46 along the edge of the interior space of the second extent 24. The groove 46 is used for receiving and/or aligning the cable 30 around a peripheral edge 38 of the container 20. The guide 42 on the fastener 40 feeds the cable 30 into the groove 46 when fastening edges of the first 22 and second 24 extents using the fastener 40. FIG. 3 shows the end of the fastening process, where the connector 32 is received in a receptor 48 that is included with the pivotal coupling 34. In such a configuration where both extents 22, 24 are fastened together, the container 20 is easily transported without the dangling of the cable 30. The container 20 may preferably be fastened during transportation and unfastened during use. It should be noted that the groove 46 may be able to accommodate more than one cable 30 and that the guide 42 may be able to feed more than one cable 30 into the groove 46.

The preferred embodiment of the present invention also discloses a method for managing at least one cable in a portable storage container using a fastener with a guide to feed the at least one cable into a groove, where the groove is along an edge of the container. The portable storage container may include at least one speaker driver and the portable storage container may also be able to contain a device like a media player, a portable radio tuner or a mobile phone. It should be noted that the groove may be able to accommodate more than one cable and that the guide may be able to feed more than one cable into the groove.

Whilst there has been described in the foregoing description preferred embodiments of the present invention, it will be understood by those skilled in the technology concerned that many variations or modifications in details of design or construction may be made without departing from the present invention.

The invention claimed is:

1. A portable storage container with cable management functionality, including:

a case with a first extent and a second extent in an adjacent relationship therewith, the first and second extent each defining an interior space for the placement of at least one speaker driver in at least one extent, the at least one speaker driver being connectable to a source through a cable with a connector, rear portions of the first and second extent being pivotally coupled together, at least one extent having an extended rim along an edge of the interior space, the rim defining a groove along the edge of the interior space, the groove being for receiving or aligning the cable, and a fastener for fastening edges of the first and second extent, wherein the fastener is for feeding the cable into the groove when fastening the edges of the first and second extents.

2. The portable storage container as claimed in claim 1, wherein the case is constructed of a relatively rigid material selected from the group consisting of: wood, metal and plastic.

3. The portable storage container as claimed in claim 1, wherein the connector is selected from the group consisting of: USB male connector, IEEE 1394 male connector, customized male connector, and an audio jack.

4. The portable storage container as claimed in claim 1, wherein the adjacent relationship is selected from the group consisting of: side-by-side, substantially perpendicular and any position between side-by-side and perpendicular.

5. The portable storage container as claimed in claim 1, wherein the interior space in each extent for further includes a holder for the at least one speaker driver.

6. The portable storage container as claimed in claim 5, wherein the holder is able to absorb reasonable or normal impact forces to prevent, reduce or minimize damage to the at least one speaker driver.

7. The portable storage container as claimed in claim 5, wherein the holder allows for the movement of the at least one speaker driver.

8. The portable storage container as claimed in claim 1, wherein exterior surfaces of the first and second extent allow for adherence of interchangeable skins for a varied appearance.

9. The portable storage container as claimed in claim 1, wherein the rigid material of the case protects the contents enclosed in the container.

10. The portable storage container as claimed in claim 1, wherein the container is in a configuration selected from the group comprising: fastened and unfastened.

11. The portable storage container as claimed in claim 1, wherein a peripheral wall of each extent is for supporting the container in an upright position.

12. The portable storage container as claimed in claim 1, wherein the pivotal coupling of the first and second extents is for supporting the container in an upright position.

13. The portable storage container as claimed in claim 1, wherein the pivotal coupling of the first and second extents includes a receptor for the connector when the container is fastened.

14. The portable storage container as claimed in claim 1, wherein the fastener includes a guide to feed the cable into the groove.

15. The portable storage container as claimed in claim 1, wherein the fastener is selected from the group consisting of: a sliding fastener, a toothed zipper and a toothless zipper.

16. The portable storage container as claimed in claim 1, wherein the second extent is for the placement of a device selected from the group comprising: a media player, a portable radio tuner and a telephone.

17. The portable storage container as claimed in claim 1, wherein the at least one speaker driver is connected to receive input selected from the group comprising: audio signals, power and a combination of audio signals and power.

18. A method for managing at least one cable in a portable storage container comprising: sliding a fastener with a guide to feed the cable into a groove, wherein the groove is along an edge of the container.

19. The method as claimed in claim 18, wherein the portable storage container includes at least one speaker driver.

20. The method as claimed in claim 18, wherein the portable storage container is able to contain a device selected from the group comprising: a media player, a portable radio tuner and a mobile phone.

21. The method as claimed in claim 18, wherein the fastener is selected from the group consisting of: a sliding fastener, a toothed zipper, and a toothless zipper.

* * * * *